United States Patent [19]

Tezcan

[11] Patent Number: 4,819,007

[45] Date of Patent: Apr. 4, 1989

[54] SUPPORTING STRUCTURE FOR REFLECTOR-TYPE MICROWAVE ANTENNAS

[75] Inventor: Hulusi E. Tezcan, Tinley Park, Ill.

[73] Assignee: Andrew Corporation, Orland Park, Ill.

[21] Appl. No.: 65,289

[22] Filed: Jun. 22, 1987

[51] Int. Cl.[4] ..... H01Q 19/12

[52] U.S. Cl. ..... 343/840; 343/880; 343/882; 343/765

[58] Field of Search ..... 343/839, 840, 765, 878, 343/880, 881, 882

[56] References Cited

U.S. PATENT DOCUMENTS

| | | | |
|---|---|---|---|
| 3,299,428 | 1/1967 | Tessari | 343/829 |
| 4,251,819 | 2/1981 | Vickland | 343/765 |
| 4,404,565 | 9/1983 | Gurney et al. | 343/881 |
| 4,550,319 | 10/1985 | Ganssle et al. | 343/882 |
| 4,652,890 | 3/1987 | Crean | 343/882 |

FOREIGN PATENT DOCUMENTS

| | | | |
|---|---|---|---|
| 2247829 | 5/1975 | France | 343/765 |
| 0207702 | 11/1984 | Japan | 343/880 |
| 0136401 | 7/1985 | Japan | 343/878 |
| 0182803 | 9/1985 | Japan | 343/840 |

*Primary Examiner*—William L. Sikes

*Assistant Examiner*—Le Hoanganh

*Attorney, Agent, or Firm*—Stephen G. Rudisill

[57] ABSTRACT

A reflector-type microwave antenna includes a paraboloidal reflector and a feed horn located at the focal point of the reflector for launching microwave signals onto the reflector and receiving microwave signals from the reflector. A supporting frame for the reflector and feed horn includes three arms extending along the rear side of the reflector to three spaced mounting locations on the rear side of the reflector. The arms are fastened to the spaced mounting locations on the rear side of the reflector by fastening means having a loose condition in which the arm is attached to the reflector but free to move relative to the reflector, and a tightened condition in which the respective arm is rigidly attached to the reflector. The fastening also includes swivel means for permitting tilting movement of the arm relative to the reflector surface when the fastening means is in the loose condition, and permitting the arm to assume different positions relative to the reflector when the fastening means is in the tightened condition. In its preferred form, the fastening means includes a cupped member having a peripheral flange secured to the rear side of the reflector so that forces transmitted between the respective arms and the reflector are distributed over the area of the reflector encompassed by the flanges.

11 Claims, 2 Drawing Sheets

SUPPORTING STRUCTURE FOR REFLECTOR-TYPE MICROWAVE ANTENNAS

FIELD OF THE INVENTION

The present invention relates generally to reflector-type microwave antennas and, more particularly, to a unique supporting structure which is especially useful with VSAT (Very Small Aperture Terminal) antennas. VSAT antennas are used in the Ku band, receiving in the 11.70 to 12.20 GHz band and transmitting in the 14.00 to 14.50 GHz band. VSAT systems are coming into widespread use in private communication systems. A single system can require thousands of antennas, particularly when one of the primary functions of the system is to provide continual communications to and from a large number of facilities such as sales outlets, regional and local offices, service centers and the like. Because of the large number of antennas required in these systems, it is not only important that such antennas be manufactured at a low cost, using mass production techniques, but also that the antennas be easily assembled and installed in the field by unskilled labor and with consistent results.

SUMMARY OF THE INVENTION

It is a primary object of the present invention to provide an improved reflector-type microwave antenna which can be mass produced at a low cost and quickly assembled in the field without distorting the critical shape of the reflector, even when the assembly is done by unskilled workers who are not familiar with techniques for installing microwave antennas.

It is another important object of this invention to provide such an improved reflector-type microwave antenna which includes self-aligning connections between the paraboloidal reflector and the supporting frame, so that the critical shape of the reflector is not distorted even though the mass-produced parts vary over a relatively wide range of manufacturing tolerances.

It is a further object of this invention to provide an improved reflector-type microwave antenna which produces improved patterns in both the horizontal and vertical planes.

Yet another object of this invention is to provide a low-cost reflector supporting and mounting structure which facilitates aiming of the antenna while also providing good structural integrity.

Other objects and advantages of the invention will be apparent from the following detailed description and the accompanying drawings.

In accordance with the present invention, the foregoing objectives are realized by providing a reflector-type microwave antenna comprising the combination of a paraboloidal reflector and a feed horn located at the focal point of the reflector for launching microwave signals onto the reflector and receiving microwave signals from the reflector; a supporting frame for the reflector and feed horn, the frame including three arms extending along the rear side of the reflector to three spaced mounting locations on the rear side of the reflector; and means for fastening the arms to the spaced mounting locations on the rear side of the reflector, each of the fastening means having a loose condition in which the respective arm is attached to the reflector but free to move relative to the reflector, and a tightened condition in which the respective arm is rigidly attached to the reflector, the fastening means also including swivel means for permitting tilting movement of the respective arm relative to the reflector surface when the fastening means is in the loose condition, and permitting the arm to assume different positions relative to the reflector when the fastening means is in the tightened condition.

In its preferred form, the fastening means includes a cupped member having a peripheral flange secured to the rear side of the reflector so that forces transmitted between the respective arms and the reflector are distributed over the area of the reflector encompassed by said flanges, a bolt fastening the central portion of each of the cupped members to one of the radial arms, and the swivel means is disposed between each of the bolts and the respective arms to permit the arms to be tilted relative to the axis of said bolt.

To reduce the adverse effect of the feed support on the antenna patterns, the supporting frame includes a boom extending forwardly from the edge of the reflector into the aperture of the reflector for supporting the feed horn, and the boom surface that faces the axis of the antenna aperture has an inverted V-shaped transverse cross section. The angle of the inverted V-shaped cross section is preferably about 100°.

DESCRIPTION OF THE PREFERRED EMBODIMENT

Figure 1:
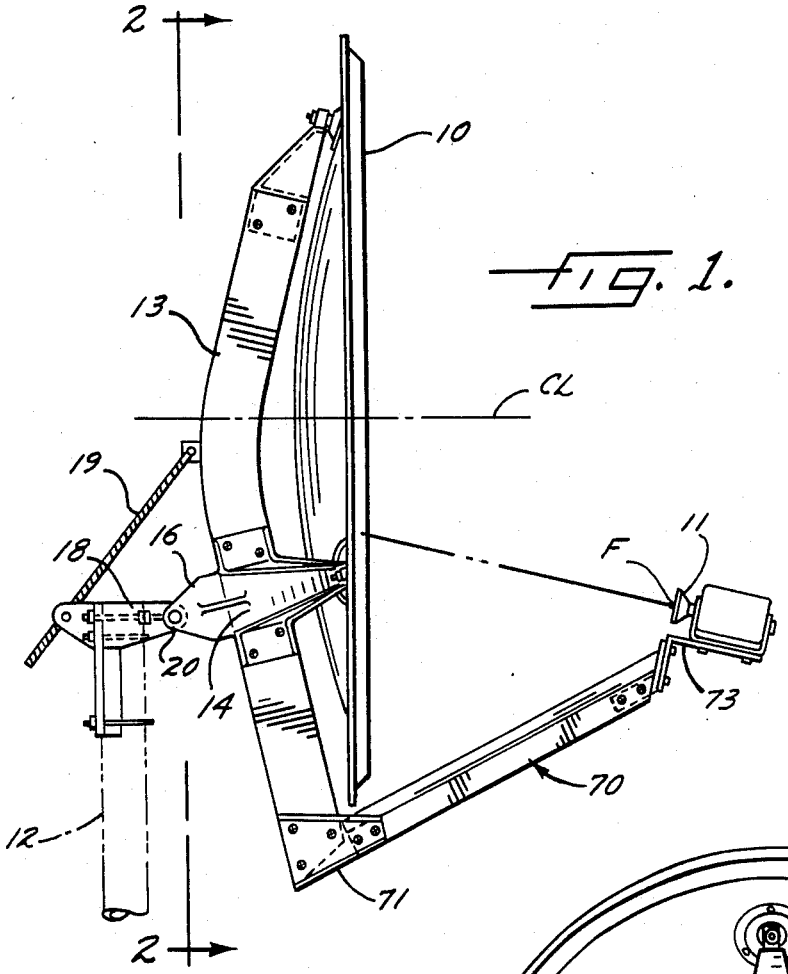
FIG. 1 is a side elevation of a VSAT antenna embodying the invention.

While the invention is susceptible to various modifications and alternative forms, certain preferred embodiments thereof have been shown by way of example in the drawings and will be described in detail. It should be understood, however, that it is not intended to limit the invention to the particular forms described, but, on the contrary, the intention is to cover all modifications, equivalents, and alternatives falling within the spirit and scope of the invention as defined by the appended claims.

Turning now to the drawings and referring first to FIG. 1, the illustrative antenna includes a paraboloidal reflector 10 for reflecting both transmitted and received microwave signals between a remote station and a feed horn 11. The reflector 10 is preferably biaxially stretch-formed from an aluminum disc, with the periphery of the disc being bent rearwardly and then outwardly to stiffen the reflector. The feed horn 11 is located at the focal point F of the paraboloid which defines the concave surface of the reflector 10.

As is well known, the performance of a reflector-type microwave antenna is optimized if the reflecting surface is not only manufactured to conform with the desired paraboloidal shape in the first place, but also maintained in that desired configuration during installation and operation of the antenna. The extent to which the reflector surface deviates from the desired theoretical paraboloidal configuration is usually expressed in units of "RMS", which is the numerical result of a well known technique for evaluating the precision of the reflector surface based on a number of measurements of the actual deviation of various points of the reflector surface from the desired theoretical shape.

Figure 2:
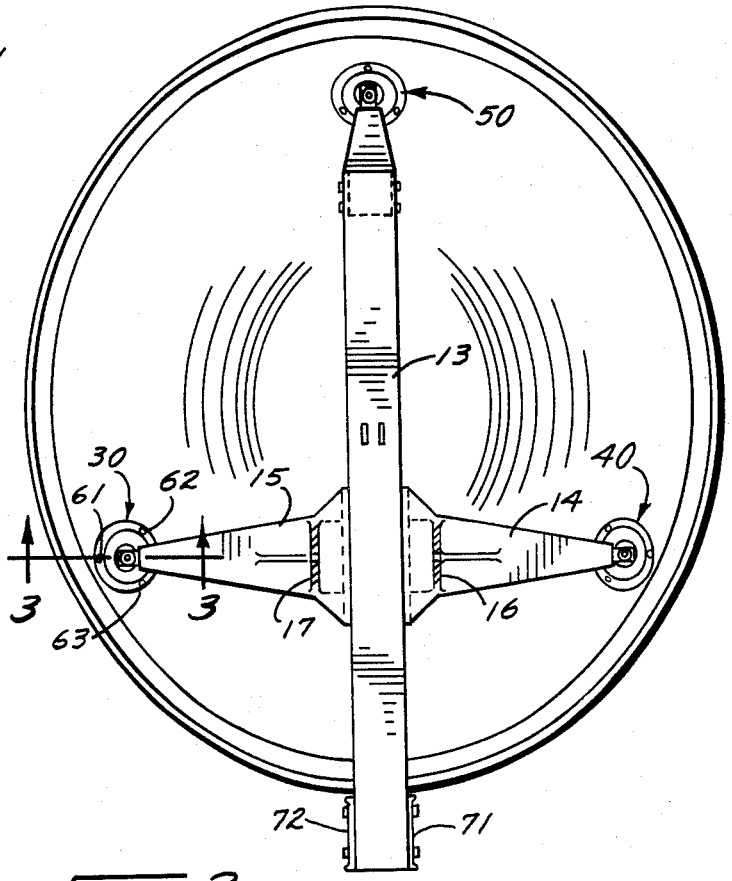
FIG. 2 is a vertical section taken generally along line 2—2 in FIG. 1 to provide a rear elevation view of the major portion of the antenna structure.

As can be seen most clearly in FIG. 2, the illustrative antenna is of the "offset" type because the focal point F the paraboloidal surface is offset from the center line CL of the antenna aperture. This offset arrangement locates the feed horn 11 away from the region of highest field intensity in the antenna aperture, and thereby reduces the adverse effect of the feed blockage of the aperture. This offset configuration also enables the supporting structure for the feed horn 11 to be located in a region of relatively low field intensity toward the edge of the antenna aperture, which reduces the deleterious effect of the supporting structure on the antenna patterns.

On the rear side of the reflector, the antenna is mounted on a vertical post 12 by a framework which includes a curved vertical beam 13 and a pair of side arms 14 and 15 extending laterally from opposite sides of the beam 13. The two side arms 14 and 15, which are preferably aluminum castings, are bolted rigidly to opposite sides of the vertical beam 13, which is suitably formed from square aluminum tubing.

The side arms 14 and 15 also include rearwardly extending flanges 16 and 17 for pivotally securing the antenna to a mating mount casting 18 fastened to the top of the post 12. This pivotal mounting facilitates aiming of the antenna by permitting the antenna to be readily adjusted in elevation by means of an adjustment strut 19. When the antenna has been adjusted to the desired elevation, the flanges 16 and 17 are locked rigidly to mount casting 18 by tightening a nut on a bolt 20 which is passed through the flanges and the bracket.

In accordance with one important aspect of the present invention, the outer ends of the two side arms 14 and 15 and the upper end of the vertical beam 13 are fastened to the rear side of the reflector at three spaced mounting locations, and the fastening means at each of these three locations includes swivel means for permitting relative tilting movement between the frame members and the reflector surface before the fastening means is tightened. Thus, in the illustrative embodiment shown in FIG. 3, the outer end of the side arm 15 is fastened to a support member 30 on the rear side of the reflector by means of a bolt 31 carrying a pair of spherical nuts 32, 33 nesting in complementary concave washers 34 and 35 on opposite sides of the arm 15. It will be noted that the holes formed in the arm 15 and the washers 34 and 35 for receiving the bolt 31 have diameters greater than that of the bolt 31 so that an annular space is left between the bolt 31 and the arm 14 to allow a limited degree of pivotal movement between the arm and the bolt. Thus, when the nuts 32 and 33 are loose, the arm 15 can be tilted relative to the axis of the bolt 31 by pivoting about the swivel joints formed by the nuts 32, 33 and the washers 34, 35.

As will be apparent from the ensuing description, the axis of the bolt 31 is ultimately fixed by the shape of the reflector 10 and the support members 30. Consequently, the swivel joints enable the arm 15 to assume different positions relative to the reflector surface. When the nuts 32 and 33 are subsequently tightened to clamp the arm 15 rigidly to the bolt 31 and the support member 30, the swivel joints allow the arm to remain in its assumed position without exerting distorting stresses on either the arm 15 or the reflector 10.

When the various components of the antenna assembly are mass produced using high speed manufacturing techniques, the locations of the various elements to be assembled will vary within the normal range of manufacturing tolerances. For example, in the particular subassembly illustrated in FIG. 3, variations will occur in the location of the outer portion of the support arm 15, the location of the bolt hole formed in that arm for receiving the bolt 31, the angles between the axis of the bolt hole and the planes of the adjacent surfaces of the support arm 15 and the rearmost portion of the support member 30, the location of the support member 30 relative to the other two support members affixed to the back of the reflector 10, and the location of the bolt-receiving hole in the support member 30. With the swivel joints formed by the spherical nuts and washers, variations in the alignment of the various components due to manufacturing tolerances are accommodated by allowing the arm 15 to assume different angular positions relative to the axis of the bolt 31 and the support member 30. Indeed, the assembly is actually self-aligning because the arm 15 will tilt automatically during the assembly of the various components, to accommodate any misalignments that might exist.

Figure 3:
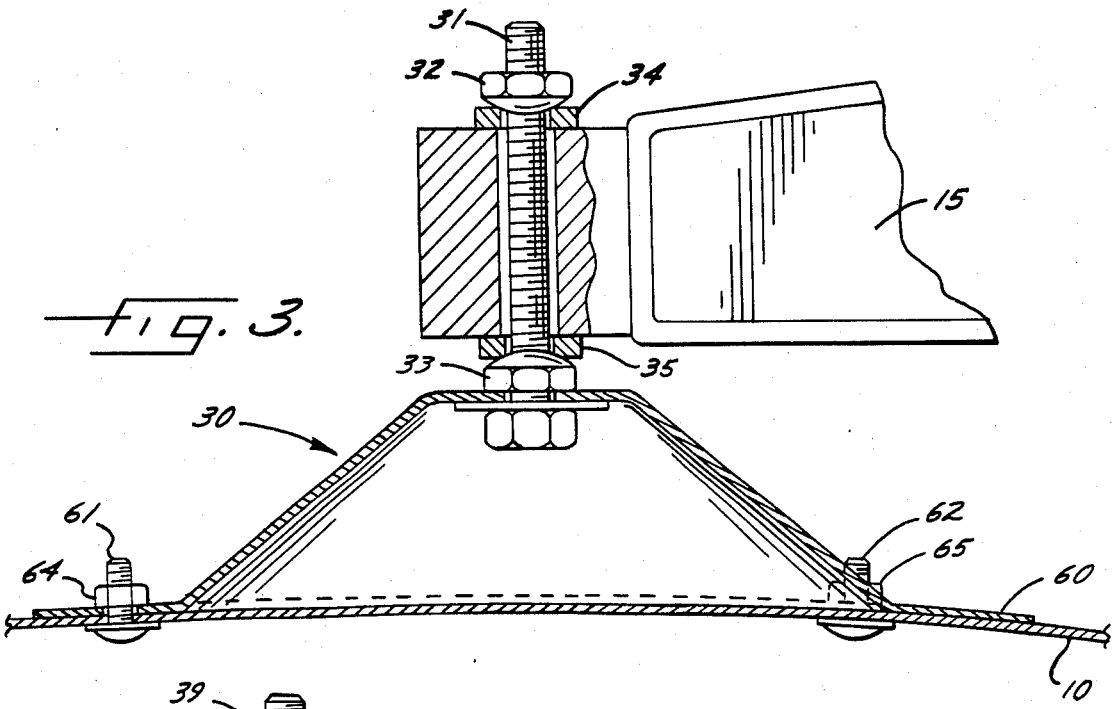
FIG. 3 is an enlarged section taken generally along line 3—3 in FIG. 2.
Figure 4:
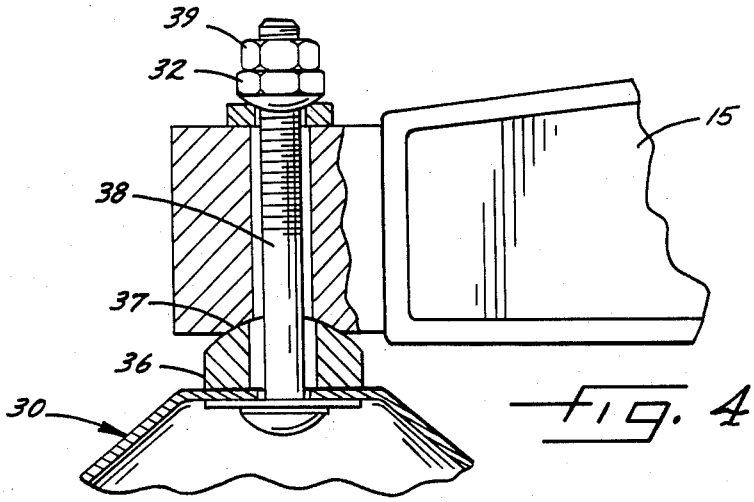
FIG. 4 is a view similar to a portion of FIG. 3 but showing a modified design for this portion of the antenna structure.
Figure 5:
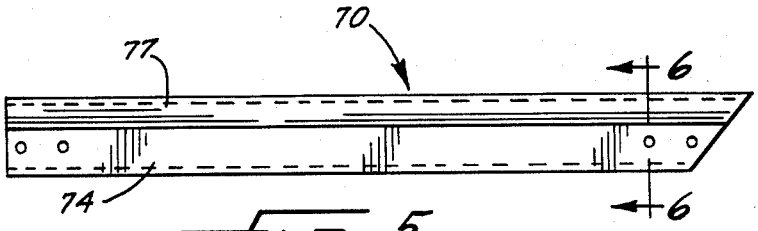
FIG. 5 is an enlarged side elevation of the boom which supports the feed horn in the antenna of FIG. 1.

A modified swivel joint assembly is illustrated in FIG. 4. In this design the spherical nut 33 and the corresponding washer 35 are replaced with a single spherical washer 36 formed with a spherical surface 37 which nests in a complementary recess formed in the front side of the arm 15. The spherical washer 36 is located at the head end of a round head, square neck bolt 38 which passes through the arm 15. The other end of the bolt 31 is provided with the same spherical nut 32 and washer 34 used in the design of FIG. 3, with the addition of a locking nut 39. This arrangement again provides swivel joints on both sides of the arm 15, i.e., at opposite ends of the bolt 38, to permit limited pivoting movement between the bolt 38 and the arm 15.

The second side arm 14 and the main beam 13 are connected to the reflector 10 via fastening assemblies similar to the assembly described for the side arm 15. These fastening assemblies include support members 40 and 50 identical to the support member 30 associated with the side arm 15. Similar swivel joints are provided in the connections to each of the three support members 30, 40 and 50, so that the relative movements necessary to accommodate misalignments at all three fastening locations will be readily.

In accordance with another important aspect of this invention, the support member at each of the three fastening locations comprises a cupped member having a peripheral flange secured to the rear side of the reflector, so that forces transmitted between the frame and the reflector are distributed over the area of the reflector encompassed by the flange. Excessive stresses could be introduced into the reflector if the three attachments to the relatively thin reflector were effected at only three single points. The use of the cupped fastening members avoids such excessive stresses by distributing forces over a relatively large area of the reflector at each of the three fastening locations. For example, in the case of a 1.8-meter reflector used for VSAT applications, each of the cupped support members 30, 40 and 50 preferably has a diameter of 10 to 12 inches, thereby distributing transmitted forces over an area of about 100 square inches rather than concentrating those forces at three single points.

In the illustrative embodiment shown in FIG. 3, the cupped support member 30 is formed as a one-piece stamping which includes an outwardly extending flange 60 around its outer periphery and attached to the reflector 10 by three bolts 61, 62 and 63 and corresponding nuts 64, 65 and 66. The central portion of the support member 30 extends rearwardly away from the reflector 10 for attachment to the side arm 15 via the bolt 31, which passes through a hole formed in the center of the rearmost portion of the support member 30. The rearwardly extending walls of the support member 30 can flex somewhat to prevent small forces, or a corresponding fraction of larger forces, from having any significant effect on the shape of the reflector.

As a further feature of this invention, the feed horn 11 is supported on the end of a cantilevered boom whose inwardly facing surface has an inverted V-shaped transverse cross section for reducing the adverse effect of the boom on the antenna pattern in the region occupied by the boom. Even with the offset feed and the use of a single cantilevered support member to hold the feed horn, reflections from the feed support can still introduce significant distortions into the antenna's patterns. It has been found that a feed support boom having the surface geometry of this invention significantly improves the patterns, to an extent which brings the patterns within FCC specifications.

In the particular embodiment illustrated in the drawings, the feed horn 11 is supported on the end of a boom 70 which is cantilevered from the bottom of the vertical beam 13. The beam 13 and the boom 70 are connected by a pair of gussets 71 and 72 bolted to the beam and boom. The boom 70 extends forwardly past the edge of the reflector 10 toward the focal point of the paraboloidal surface, i.e., into the aperture of the antenna. The feed horn 11 is mounted on a L-shaped bracket 73 bolted to the forward end of the boom 70.

Figure 6:
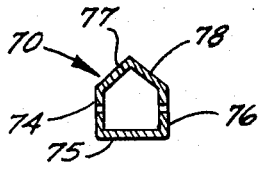
FIG. 6 is a section taken generally along line 6—6 in FIG. 5.

As can be seen most clearly in FIG. 6, the boom 70 has a pentagonal cross section, with three orthogonal walls 74, 75 and 76. The other two walls 77 and 78 intersecting walls 74 and 76 at angles of 130°, forming an included angle of 100° between the walls 77 and 78. Thus, the two walls 77 and 78 form the inverted V-shaped surface referred to above, and it is this surface which faces the axis of the antenna aperture. Of course, it is not necessary for the peaked surface formed by the non-orthogonal walls 77 and 78 to be formed by load-bearing walls of the boom 70; the boom could be formed from conventional square tubing, with a relatively thin inverted V-shaped reflector attached to one side of the tubing.

It can be appreciated from the foregoing description that the antenna support structure provided by this invention can be easily assembled in the field by unskilled labor, with little risk of distorting the paraboloidal shape of the reflector. The various components of the support assembly can all be attached to each other by the use of conventional bolts, nuts and screws, and the self-aligning connections to the reflector not only prevent distortion of the reflector shape but also accommodate manufacturing tolerances in the various parts being assembled. Furthermore, the assembly can be accomplished without the use of any expensive fixtures or special adhesives, and can be completed quickly, even when performed in the field. Furthermore, all the individual parts can be readily mass produced using conventional techniques such as stamping and casting, without the need for any precision machining of mating parts.

I claim:

1. A reflector type microwave antenna comprising the combination of a paraboloidal reflector and a feed horn located at the focal point of the reflector for launching microwave signals onto the reflector and receiving microwave signals from the reflector;

a supporting frame for the reflector and feed horn, said frame including three arms extending along the rear side of the reflector to three spaced mounting locations on the rear side of the reflector; and means for fastening the arms to said spaced mounting locations on the rear side of the reflector, each of said fastening means having a loose condition in which the respective arm is attached to the reflector but free to move relative to the reflector, and a tightened condition in which the respective arm is rigidly attached to the reflector, said fastening means also including swivel means for permitting tilting movement of the respective arm relative to the reflector surface when the fastening means is in said loose condition, and permitting said arm to assume different positions relative to the reflector when the fastening means is in said tightened condition.

2. The antenna of claim 1 wherein each of said fastening means includes a cupped member having a peripheral flange secured to the rear side of said reflector so that forces transmitted between the respective arms and said reflector are distributed over the area of the reflector encompassed by said flanges, a bolt fastening the central portion of each of said cupped members to one of the radial arms, and said swivel means is disposed between each of said bolts and the respective arms to permit the arms to be tilted relative to the axis of said bolt.

3. The antenna of claim 2 wherein said swivel means includes spherical nuts and washers.

4. The antenna of claim 2 wherein said swivel means includes concave/convex washers and regular nuts.

5. The antenna of claim 2 wherein said swivel means includes a concave washer and a convex nut.

6. The antenna of claim 2 wherein said swivel means includes a convex washer and a concave nut.

7. A reflector-type microwave antenna comprising the combination of a paraboloidal reflector and a feed horn located at the focal point of said reflector for launching microwave signals onto said reflector and receiving microwave signals from the reflector, a supporting frame for said reflector and feed horn, said frame including three arms extending along the rear side of the reflector to three spaced mounting locations on the rear side of the reflector, and means for fastening said arms to said spaced mounting locations on the rear side of the reflector, each of said fastening means including a cupped member having a peripheral flange secured to the rear side of said reflector so that forces transmitted between the respective arm and said reflector are distributed over the area of the reflector encompassed by said flange, without deforming the appropriate shape of the reflector.

8. The antenna of claim 7 wherein each of said fastening means has a loose condition in which the respective arm is attached to the reflector but free to pivot relative to the reflector, and a tightened condition in which the respective arm is rigidly attached to the reflector, and each of said fastening means includes swivel means for permitting tilting movement of the respective arm relative to the reflector surface when the fastening means is in said loose condition.

9. A reflector-type microwave antenna comprising the combination of a paraboloidal reflector and a feed horn located at the focal point of said reflector for launching microwave signals onto said reflector and receiving microwave signals from the reflector, a supporting frame for said reflector and said horn, said frame including a boom extending forwardly from the edge of the reflector into the aperture of the reflector for supporting said feed horn, the boom surface that faces the axis of the antenna aperture having an inverted V-shaped transverse cross section for reducing the adverse effect of the boom on the antenna pattern in the region occupied by the boom.

10. The antenna of claim 9 wherein the angle of said inverted V-shaped cross section is about 100°.

11. The antenna of claim 9 wherein said boom has a pentagonal transverse cross section.

* * * * *